US006042366A

United States Patent [19]

Long et al.

[11] Patent Number: 6,042,366

[45] Date of Patent: Mar. 28, 2000

[54] LANTERN HAVING A PROTECTIVE SHIELD FEATURE

[75] Inventors: Norris R. Long, Wichita; Randall L. May, Andover; Thomas Mark Benton, Wichita; Scott Wayne Luty; Robert J. Gross, both of Wichita, all of Kans.; Paul King; Mike Joss, both of Chicago, Ill.

[73] Assignee: The Coleman Company, Inc., Wichita, Kans.

[21] Appl. No.: 09/018,465

[22] Filed: Feb. 4, 1998

[51] Int. Cl.[7] ..... F21L 19/00

[52] U.S. Cl. ..... 431/142; 431/344; 431/345; 362/159; 362/186; 362/399

[58] Field of Search ..... 431/344, 345, 431/142, 350; 362/159, 160, 186, 376, 399

[56] References Cited

U.S. PATENT DOCUMENTS

| | | | |
|---|---|---|---|
| 503,955 | 8/1893 | Giddings | 362/376 |
| 564,662 | 7/1896 | Trabue | 362/159 |
| 2,665,373 | 1/1954 | Rashke | 362/399 |
| 2,841,694 | 7/1958 | Webster | 431/344 |
| 3,210,537 | 10/1965 | Groves | 431/344 |
| 4,594,647 | 6/1986 | Dippert | 362/376 |

FOREIGN PATENT DOCUMENTS

| | | | |
|---|---|---|---|
| 76335 | 3/1919 | Austria | 362/160 |

*Primary Examiner*—Ira S. Lazarus
*Assistant Examiner*—Sara Clarke
*Attorney, Agent, or Firm*—Kramer, Levin, Naftalis & Frankel LLP

[57] ABSTRACT

A lantern includes a housing, a fuel inlet, and a flame guard surrounding the region in which the fuel is burned. A shield is hingedly connected to the housing to allow movement between a closed position in which the shield protects the flame guard and blocks access to the fuel inlet, and an open position. The shield may be made of two parts, and a crenulated bail may be used to hang the lantern.

41 Claims, 8 Drawing Sheets

LANTERN HAVING A PROTECTIVE SHIELD FEATURE

BACKGROUND OF THE INVENTION

1. Field of the Invention

The present invention relates to the field of camping lanterns. More specifically, it relates to lanterns having a housing with one or more shields that protect certain parts of the lantern when the lantern is stored.

2. Description of Related Art

Camping lanterns that use propane or butane or other gas fuels are well known and have been used for some time. Lanterns that use gas fuels typically have a vertical configuration, with a gas inlet at the bottom. Typically, this gas inlet mates directly with a gas outlet located at the top of a replaceable container, canister, or tank of gas. An engine routes the gas from this container to a gas outlet or burner where the gas is burned. A globe surrounds and protects the flame from wind, and increases the lighting efficiency and safety of the lantern.

One drawback of traditional gas lanterns is that they sometimes have a relatively high center of gravity, because the lantern is installed on top of the fuel container during ordinary use. This problem may be exacerbated when the fuel container is almost empty. As a result, a base, which may be weighted, is sometimes provided to increase the stability of the lantern. But because such a base is placed under the fuel container, the base is not incorporated into the lantern itself, and must be provided as a separate piece. This may inconvenience the user if the base accidentally becomes separated from the lantern during transit or storage. In addition, such a base adds weight and bulk to the lantern, which is particularly disadvantageous for some users, such as backpackers, who are very conscious of the weight and the size of the equipment that they carry.

Another disadvantage of traditional gas lanterns is that when they are not being used, their gas inlets are exposed to the environment. As a result, the gas inlet is accessible to dirt or other debris. In addition, the gas inlet is accessible to spiders, which can spin webs inside the gas inlet. When this occurs, the lantern may not operate properly.

Yet another disadvantage of traditional gas lanterns is that the globe that surrounds the burning fuel, which is usually made of glass, can be vulnerable to breakage from impact. While a removable lantern case can protect both the globe and the gas inlet, removable cases have a number of drawbacks. First, a removable case must be stored when the lantern is used, which can be a problem in certain circumstances such as in a tent where storage space is limited. Second, because the case must be removed before the lantern is used, the case can become separated from the lantern. When this occurs, the user may have to search for the case when it is time to place the lantern out of use or store the lantern. Finally, the case can be relatively heavy and bulky, which again is particularly disadvantageous for certain users.

Uniflame™ makes a number of compact lanterns with built-in cases. In one Uniflame™ lantern, the globe and burner extend upward and downward within a vertically oriented housing that protects the globe when the lantern is in a stored position. Another Uniflame™ model, the UL-C lantern, shown in FIG. 4, protects the globe 101 with a built-in folding case 102 that includes a first section 103 and a second section 104. However, the built-in case 103 does not protect the gas inlet 105 from spiders and other debris, because the gas inlet 105 remains accessible via opening 106 even when the case 103 is closed. In addition, because the second section 104 folds over the top of the globe 101, the case 102 extends above the top of the lantern when the case 102 is closed. This configuration makes it difficult to hang the model UL-C lantern from a permanently attached bail (i.e., handle).

SUMMARY OF THE INVENTION

The present invention advantageously provides a low profile lantern that includes a shield to protect the globe and the gas inlet when the lantern is not in use, can be easily hung from a bail, and does not require a separatable base for support.

In accordance with one aspect of the present invention, a lantern is provided. The lantern includes a housing, a fuel inlet connected to the housing for receiving fuel from a fuel container, and a fuel outlet connected to the housing for discharging the fuel into a fuel-burning region. A shield is hingedly connected to the housing to allow movement between (1) a closed position in which the shield blocks access to at least a portion of the fuel-burning region and covers the fuel inlet, and (2) an open position in which the shield does not block access to the fuel-burning region and the fuel inlet is uncovered.

In accordance with another aspect of the present invention, a lantern is provided. The lantern includes a housing, a fuel inlet connected to the housing for receiving fuel from a fuel container, and a fuel outlet connected to the housing for discharging the fuel into a fuel-burning region. A flame guard surrounds the fuel-burning region, and a ventilator is disposed above the fuel-burning region. A shield is hingedly connected to the housing to allow movement between (1) a closed position in which the shield blocks access to at least a portion of the fuel-burning region and covers the fuel inlet, and (2) an open position in which the shield does not block access to the fuel-burning region and the fuel inlet is uncovered.

In accordance with another aspect of the present invention, a lantern is provided. The lantern includes a housing with a sidewall with an opening therein. A fuel inlet for receiving fuel from a fuel container is fitted in the opening of the sidewall, and a fuel outlet discharges the fuel into a fuel-burning region located above the top of the housing. The lantern also includes a valve or regulator for selectively passing or blocking the flow of fuel from the fuel inlet to the fuel outlet. The fuel-burning region is surrounded by a substantially cylindrical flame guard, and covered by a ventilator. A shield having a substantially cylindrical inner face is hingedly connected to the housing to allow movement between (1) a closed position in which the shield covers the fuel inlet and the flame guard nests inside the inner face on the same side of the housing as the fuel inlet, and (2) an open position in which the shield does not cover the fuel inlet and, when the fuel container is connected to the fuel inlet, the fuel container nests inside the inner face.

The above and other features and advantages of the present invention will be apparent from the following detailed description of illustrated embodiments, which includes a number of preferred embodiments. One preferred embodiment includes a two section shield, with the second section hingedly connected to the first section. Another preferred embodiment includes a two section shield, with the second section detachably affixable to the first section. Another preferred embodiment includes a two section shield, with the second section detachably affixable to the flame guard. The detailed description is to be read in connection with the accompanying drawings, in which:

DESCRIPTION OF THE PREFERRED EMBODIMENTS

Figure 1A:
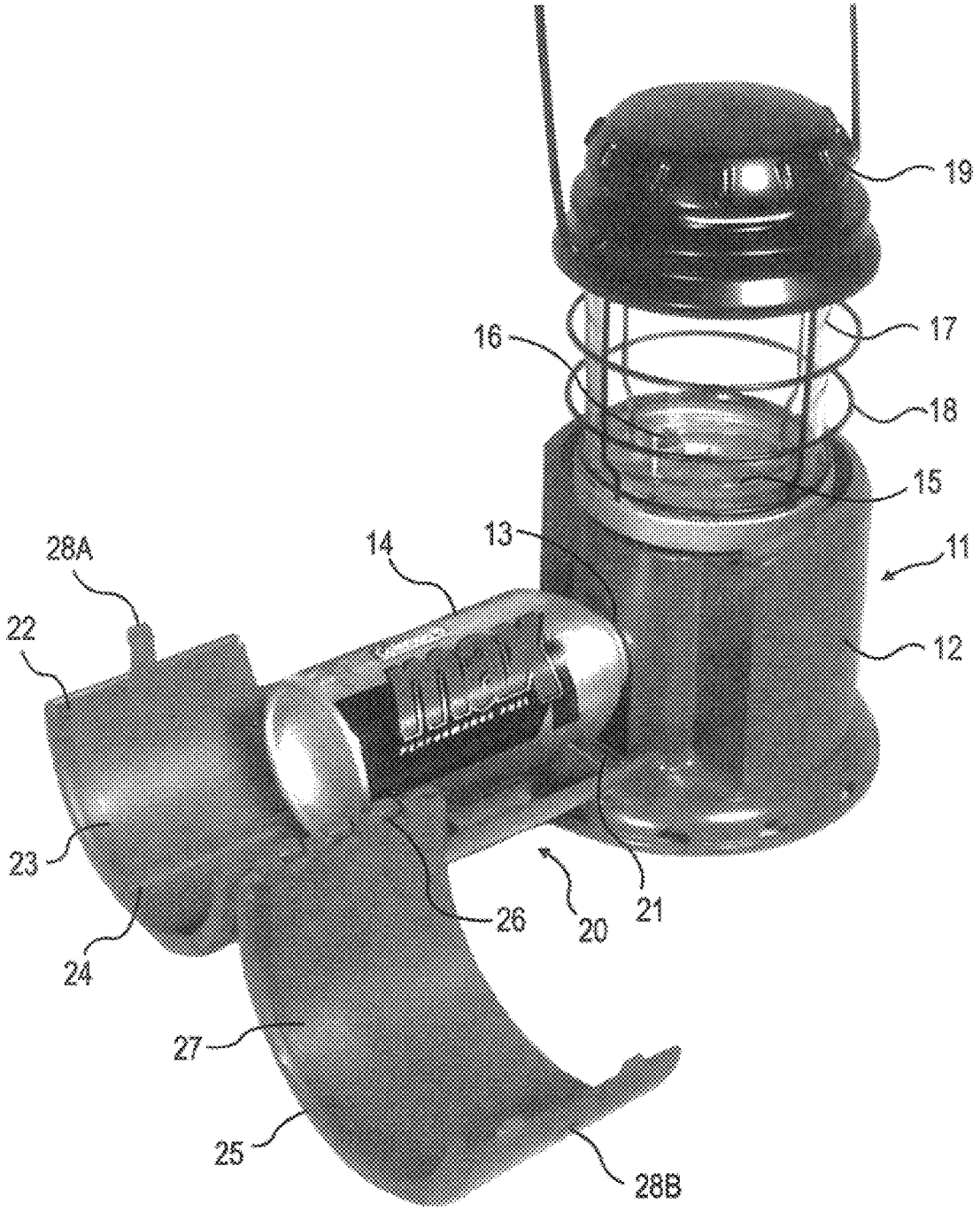
FIG. 1A is a perspective view of a lantern in accordance with a first embodiment of the present invention, with the shield in the opened position and a fuel container installed.

FIG. 1A shows a lantern in accordance with a first embodiment of the present invention, which is designed to operate using an external container of fuel. A housing 11 with a generally cylindrical sidewall 12 is included at the lower portion of the lantern. While this shape is preferred, numerous other shapes may also be used including, but not limited to, rectangular and hexagonal configurations.

The sidewall 12 (or, in the case of a polygonal housing, one of the sidewalls) has an opening 13 formed therein. The opening is fitted with an appropriate fuel inlet (51) for mating with and receiving fuel from an external fuel container 14. The fuel inlet may be either recessed, flush, or extend beyond the sidewall 12. The fuel inlet can be affixed to the sidewall 12 itself, or to another component that is located within the housing 11. Any of a wide variety of fittings will be suitable for this purpose, as will be recognized by those skilled in the art.

Near the top edge of the sidewall 12, a top face 15 is provided that is substantially horizontal when the lantern is supported on a horizontal surface. A fuel outlet 16 is fitted in this top face 15. A valve 38 (shown in FIG. 1C) is disposed in the pathway between the fuel inlet and the fuel outlet. When the valve 38 is opened, fuel flows out of the fuel container 14, into the housing 11 via the fuel inlet, through the opened valve 38, and out of the fuel outlet 16. Preferably, the control knob of valve 38 and the fuel inlet are located on opposite sides of the housing 11.

Preferably, a mantle (not shown) is secured to the fuel outlet 16. When the fuel flowing out of the fuel outlet 16 burns, this mantle dramatically increases the amount of light produced by the lantern, in a conventional manner. The region where the fuel burns is called the fuel-burning region.

A flame guard 17, 18 which may comprise, for example, components such as a glass globe 17 and/or a wire cage 18, is secured in place on top of the housing 11 so as to surround the fuel-burning region. Preferably, this flame guard 17, 18 is cylindrical and completely surrounds the fuel-burning region in a radial direction. However, non-cylindrical shapes as well as flame guards that have gaps (so that the entire flame is not enclosed) may also be used. Most preferably, the flame guard 17, 18 includes both a cylindrical glass globe 17 and a wire cage 18, with the globe disposed inside the wire cage.

The flame guard 17, 18 may be secured directly to the top of the housing 11 in a variety of ways. For example, when a wire cage 18 is used, the bottom of the wire cage may be fastened directly to the top edge of the sidewall 12 or, alternatively, to the top face 15 of the housing 11. The various portions of the flame guard 17, 18 may be either permanently or removably secured to the housing 11.

As yet another alternative, the flame guard 17, 18 may be secured indirectly to the top of the housing 11. For example, a post (not shown) or another component that extends up from the housing 11 may be used to hold the flame guard 17, 18 in place from the top of the flame guard. This configuration would be suitable for lanterns that use only a globe 17 as the flame guard, without a wire cage 18. Preferably, the globe 17 is made of glass.

A ventilator 19 is disposed above the fuel-burning region, and secured to the top of the flame guard 17, 18. The ventilator 19 may be secured directly to the flame guard 17, 18. Alternatively, when a post or another component extends up from the housing 11, the ventilator 19 may be indirectly secured to the flame guard 17, 18 by affixing the ventilator 19 to this component in a conventional manner. The ventilator 19 may be either permanently or removably secured to this component. For example, if a burner with a flat top (not shown) extends up from the housing 11, the ventilator 19 can be fastened to the top of the burner using a suitable fastener such as a bolt and a mating nut (not shown).

This embodiment uses a two piece shield that includes a first section referred to as a first shield 20, and a second section referred to as a second shield 25.

The first shield 20 is provided on the same side of the housing as the fuel inlet 51, with a hinged connection 21 that is preferably located near the bottom of the housing 11. The hinged connection 21 can include, for example, a conventional hinge with a hinge pin such as a piano hinge, a pinless hinge such as a pair of rivets or screws located at either end of the door, a foldable piece of plastic, or any other suitable arrangement that enables the hinging action to take place. Preferably, the hinge 21 is located near the bottom of the housing 11 with the axis of the hinge parallel to the supporting surface of the lantern, and with the hinge 21 and first shield 20 oriented so that the first shield 20 can be moved between an open position and a closed position, similar to the operation of a drawbridge.

Figure 1B:
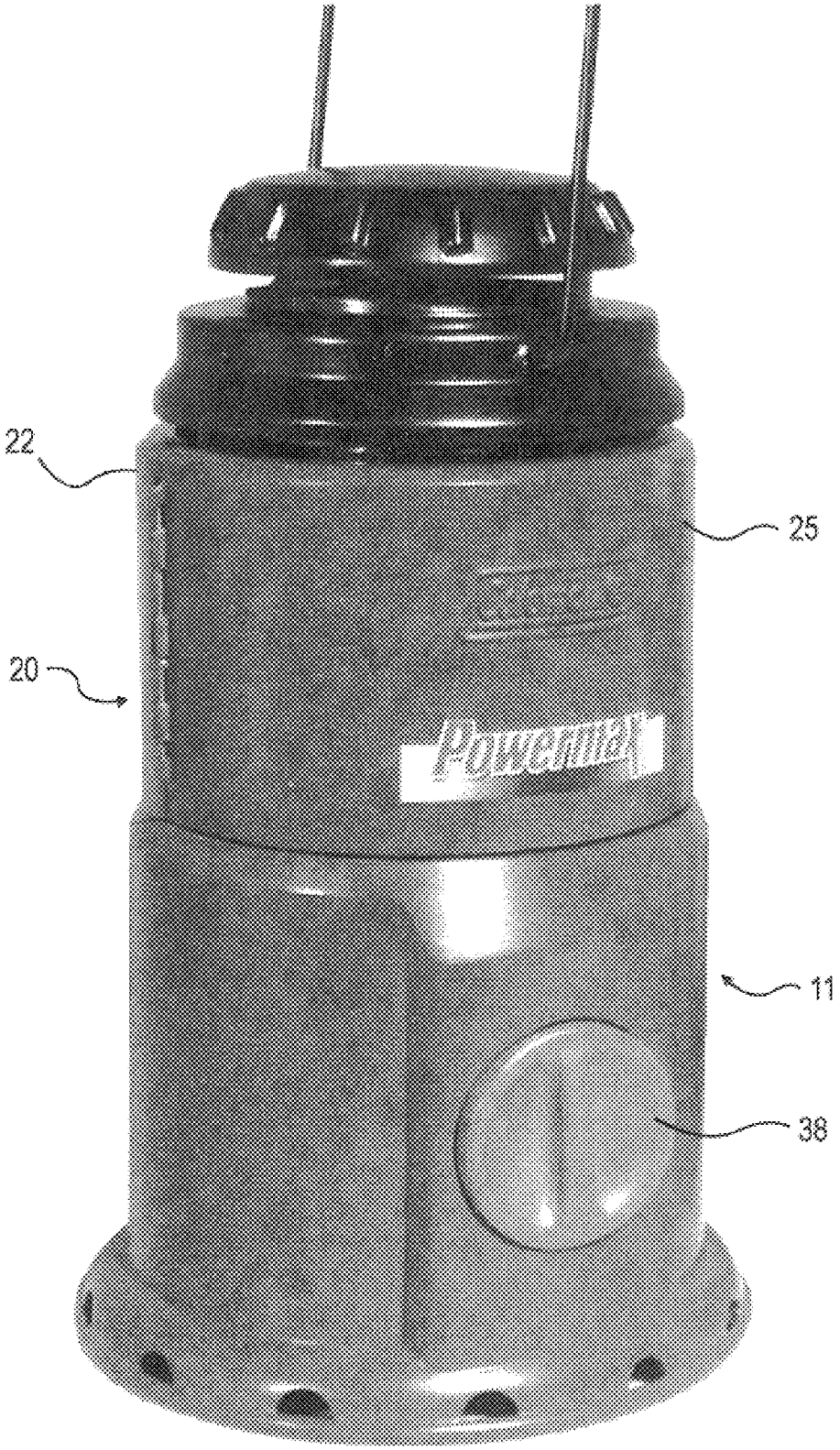
FIG. 1B is a perspective view of a lantern in accordance with the first embodiment of the present invention, with the shield in the closed position.

As seen in FIG. 1B, when the first shield 20 is in the closed position, the first shield 20 covers the fuel inlet 51 to protect it from foreign matter and objects. In particular, by covering the fuel inlet, the first shield 20 reduces the chance that the fuel inlet 51 will become contaminated by dirt. The first shield 20 also reduces the chance that a spider will access the fuel inlet and build a web inside, which could interfere with the proper operation of the lantern.

Covering the fuel inlet 51 can be accomplished, for example, by using mating components that are machined to provide a tight fit between the first shield 20 and the fuel inlet 51 when first shield is in the closed position. Alternatively, a seal between the first shield 20 and the fuel inlet can be obtained using a gasket made of a compressible material such as cork, rubber, or plastic, to seal the fuel inlet when the first shield 20 is closed. As yet another alternative, a sheet of an elastic material such as rubber, plastic, or fabric may be stretched over the fuel inlet when the first shield 20 is moved into the closed position.

With reference to FIGS. 1A and 1B, when the first shield 20 is in its closed position, the upper portion 22 of the first shield 20 extends up and covers a portion of the flame guard 17, 18. Optionally, the upper portion 22 of the first shield 20 may contain one or more vents, and may be wider than the lower portion of the shield 20. Preferably, the inner face 23 of this upper portion 22 of the first shield 20 is shaped to match the outer face of the flame guard 17, 18, so that the flame guard 17, 18 will nest inside the inner face 23. For example, when a cylindrical flame guard 17, 18 is used, the preferred inner face 23 would be cylindrical, with an inner diameter that is slightly larger than the outer diameter of the flame guard 17, 18. The arc of the cylindrical inner face 23 of the first shield 20 is preferably about 180°, so that the first shield 20 provides coverage for about half of the flame guard 17, 18. Smaller arcs may be used as well, but would provide correspondingly less coverage.

While it is preferable for the shape of the inner face 23 to match the outer face of the flame guard 17, 18, this is not required. For example, a first shield with a rectangular inner face may be used to protect a cylindrical or an oval-shaped flame guard 17, 18.

The first shield 20 may be opened by swinging the top of the first shield 20 down until it is about 90° from its closed position. The first shield 20 can be stopped in this position by a variety of mechanisms, including, for example, by using a stop connected to the housing 11 or by using the surface that supports the lantern as a stop.

In the open position the fuel inlet is accessible so that a container of fuel 14 can be connected to the fuel in let. In a preferred embodiment, the first shield 20 has a substantially cylindrical inner face 23 that is dimensioned to nest outside of the flame guard 17, 18. In the open position, the substantially cylindrical inner face 23 of the first shield 20 resembles a substantially horizontal open channel 24 or trough. Preferably, the inner diameter of the inner face 23 of this channel 24 is greater than the outer diameter of the container of fuel 14, so that the container of fuel 14 can nest inside the channel 24. In this position, the first shield 20 protects the container of fuel 14. The channel 24 can be positioned with respect to the fuel inlet so that the container 14 rests on and is supported by the inner face 23 of the channel 24 when the container 14 is installed. Alternatively, if the container 14 is supported by the fuel inlet, the channel 24 can be positioned so that the container 14 is suspended above the inner face 23 of the channel 24.

When the first shield 20 i s in the closed position, the first shield 20 only protects a portion of the flame guard 17, 18. For example, when the first shield 20 covers a 180° section of the flame guard 17, 18, the remaining 180° section of the flame guard 17, 18 remains uncovered.

In this embodiment, the remaining section of the flame guard 17, 18 is protected by a second shield 25 that is hingedly connected to the first shield 20 by hinge 26. The second shield 25 has a substantially cylindrical inner face 27. The axis of the hinged connection 26 between the first shield 20 and the second shield 25 is substantially perpendicular to the axis of the hinged connection 21 between the first shield 20 and the housing 11. As a result, when the first shield 20 is closed, the axis of the hinged connection 26 between the first shield 20 and the second shield 25 will be substantially vertical. The second shield 25 can then be swung open and shut like a door to alternately cover and reveal the portions of the flame guard 17, 18 that are not blocked by the first shield 20. When the second shield 25 is closed, tab 28A mates with hole 28B to hold the second shield in place. While the fastener shown comprises a tab 28A and a corresponding mating hole 28B, a wide variety of alternative fasteners maybe used as well.

Preferably, the first shield 20 will cover about half of the flame guard 17, 18, and the second shield 25 covers the entire region that is not covered by the first shield 20. For example, when the first shield 20 covers a 180° section of the flame guard 17, 18, the second shield 25 covers the remaining 180° section. In another example, if the first shield 20 covers a 120° section of the flame guard 17, 18, the second shield 25 covers the remaining 240° section. In this case, the second shield 25 can be made using two 120° sections with a hinge connecting the two sections (not shown), to allow it to encircle the flame guard 17, 18.

Figure 1C:
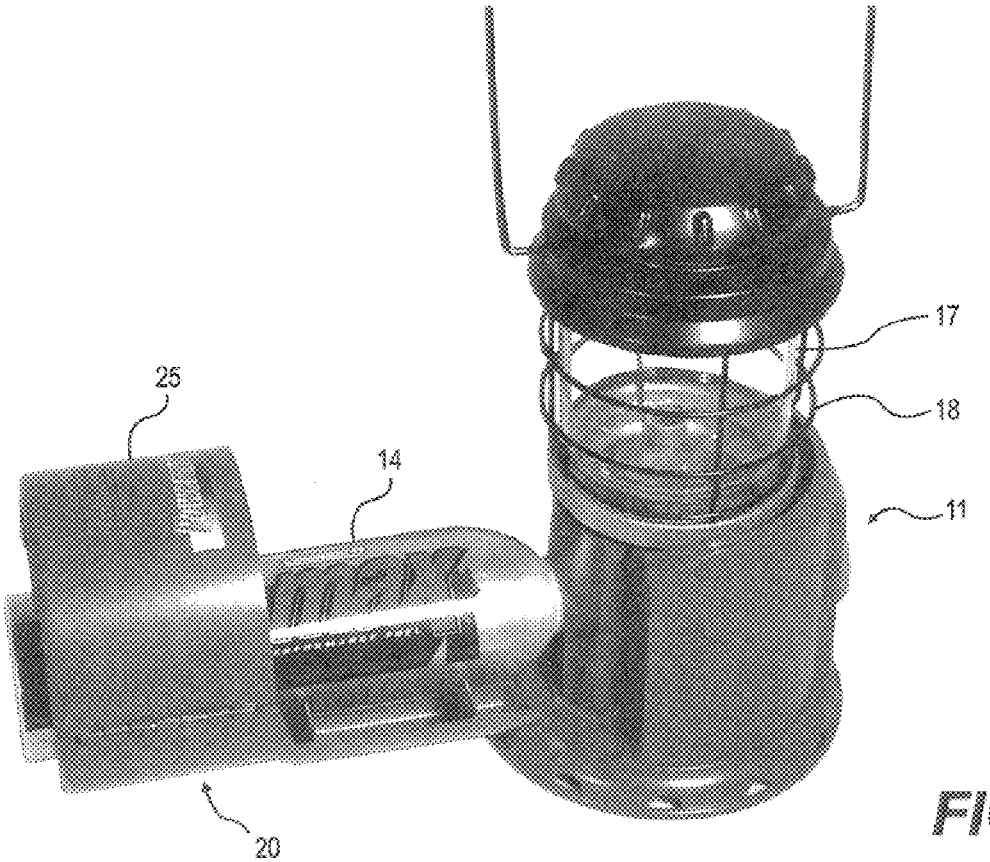
FIG. 1C is a perspective view of a lantern in accordance with the first embodiment of the present invention, with the shield in the opened position but closed around the installed fuel container.
Figure 1D:
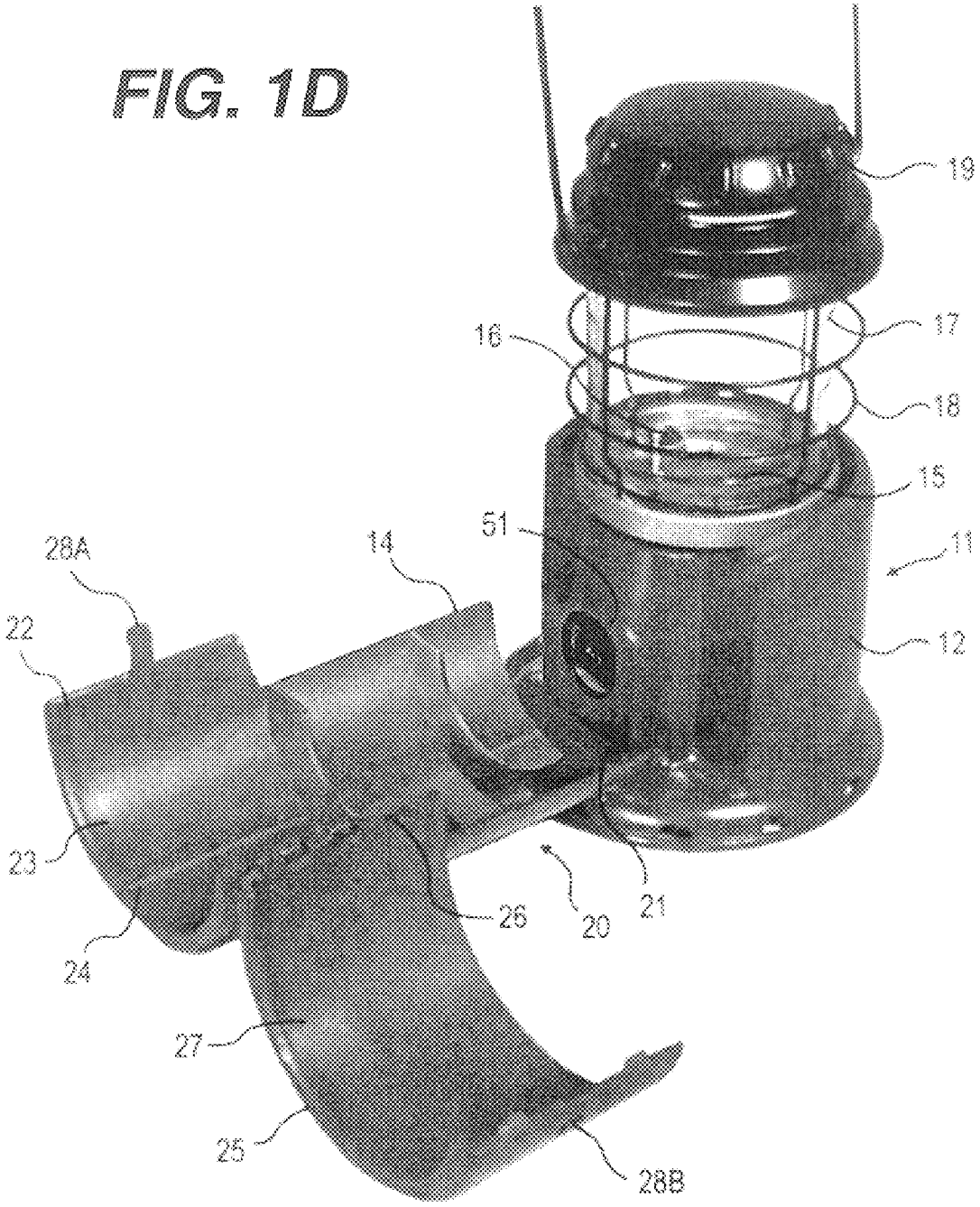
FIG. 1D is a perspective view of a lantern in accordance with the first embodiment of the present invention, with the shield in the opened position.

Turning now to FIG. 1C, when the first shield 20 is in the open position, the second shield 25 can be closed around the fuel container to protect the top of the fuel container and reduce the footprint of the lantern.

Figure 2B:
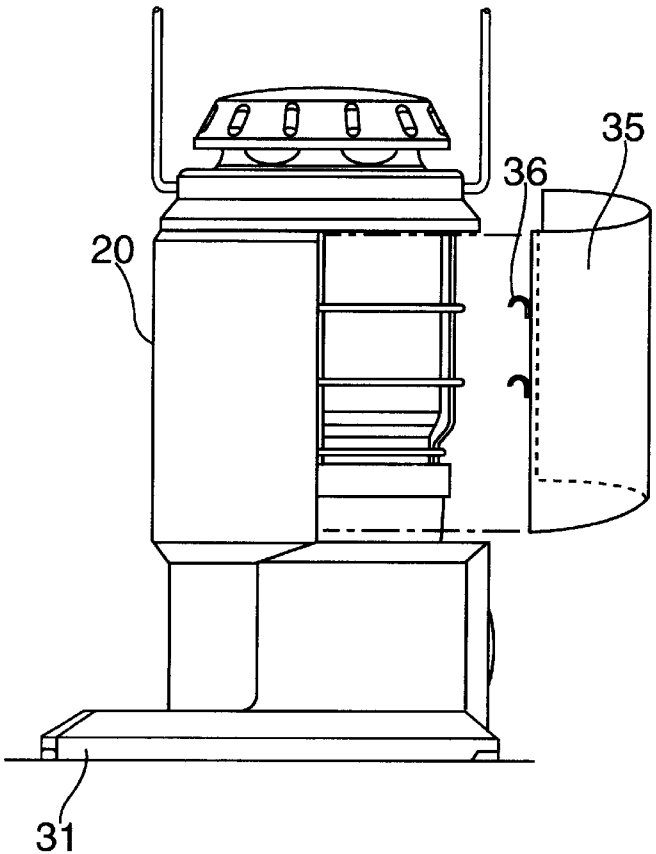
FIG. 2B is a side view of a lantern in accordance with the second embodiment of the present invention, with the shield in the closed position.
Figure 2A:
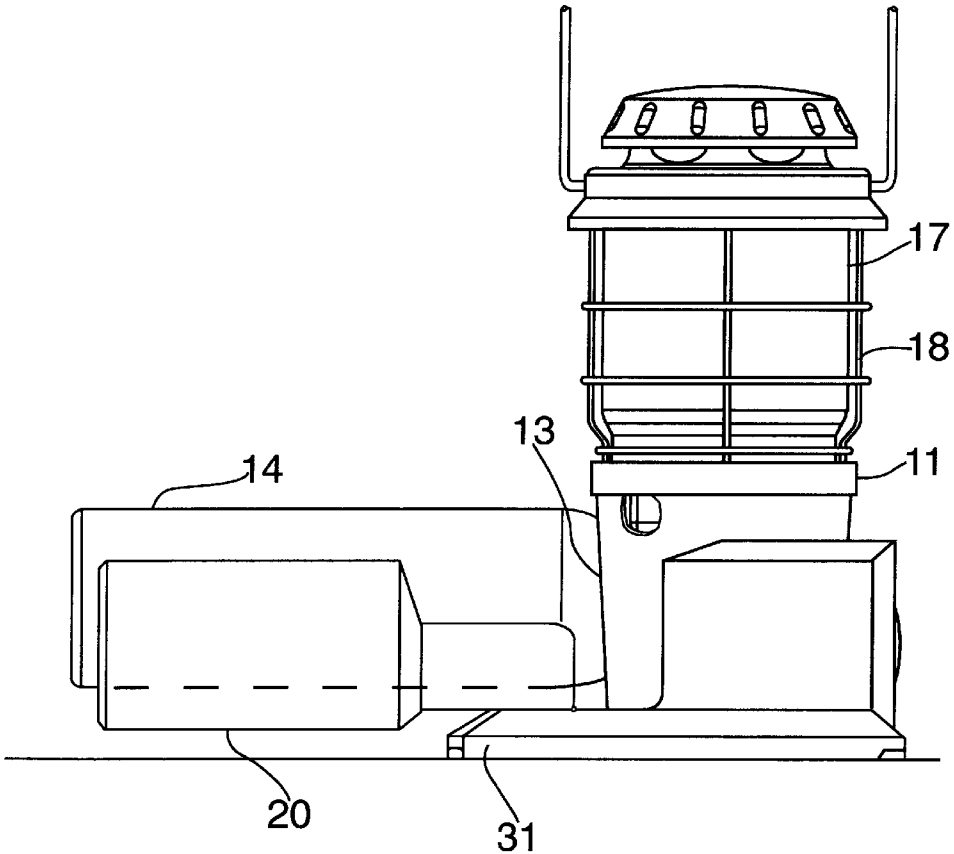
FIG. 2A is a side view of a lantern in accordance with a second embodiment of the present invention, with the shield in the open position and a fuel container installed.
Figure 2C:
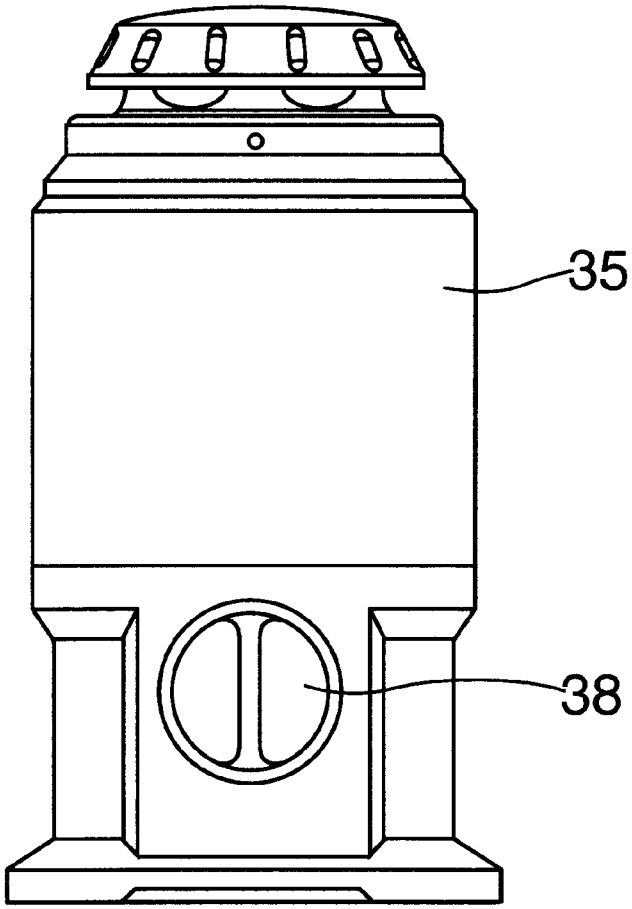
FIG. 2C is a front view of a lantern in accordance with the second embodiment of the present invention, with the shield in the closed position and the second shield installed.

A variety of alternative approaches may be used to protect the portion of the flame guard 17, 18 that is not protected by the first shield 20. For example, FIGS. 2A, 2B, and 2C show a second embodiment that includes a second shield 35. This second shield 35 attaches to and detaches from the flame guard 17, 18. Most of the elements in this embodiment are the same as those in the first embodiment described above.

When the flame guard 17, 18 includes a wire cage 18, this second shield 35 can be attached to the wire cage 18 using, for example, clips 36 (shown in FIG. 2B) or snaps (not shown). As with the first embodiment, the second shield 35 preferably covers the entire region that is not covered by the first shield, and can be made of multiple sections connected by hinges.

When a glass globe 17 is used alone as the flame guard, the second shield 35 may alternatively be attached to the housing beneath the globe or the ventilator located above the globe. Alternatively, when globe 17 is cylindrical, a cylindrical piece of spring steel (not shown) that covers more than 180° of the globe 17 may be snapped directly onto the globe 17.

If the inside of the second shield 35 is a reflecting heat-resistant surface such as polished steel, then the second shield 35 can serve as a reflector if it is left in position on the flame guard 17, 18 when the lantern is in use. Alternatively, if the reflector is not desired, the second shield 35 can be fastened to the first shield 20 for storage while the lantern is in use, as with the previous embodiment.

As seen in FIGS. 2A and 2B, an elongated base 31 may be provided at the bottom of the housing 11 to provide extra stability to the lantern. This can compensate for the shift in the center of gravity caused by the fuel container being installed into the side of the lantern.

Figure 3B:
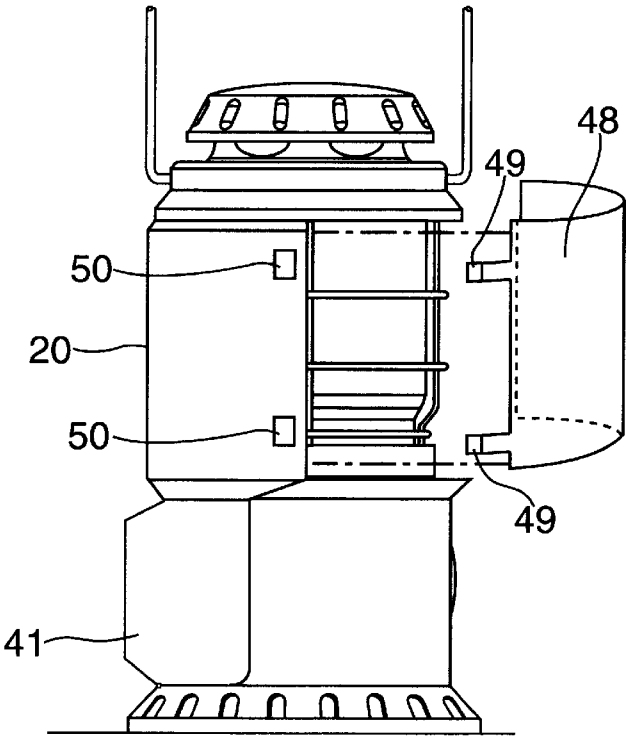
FIG. 3B is a side view of a lantern in accordance with the third embodiment of the present invention, with the shield in the closed position.
Figure 3A:
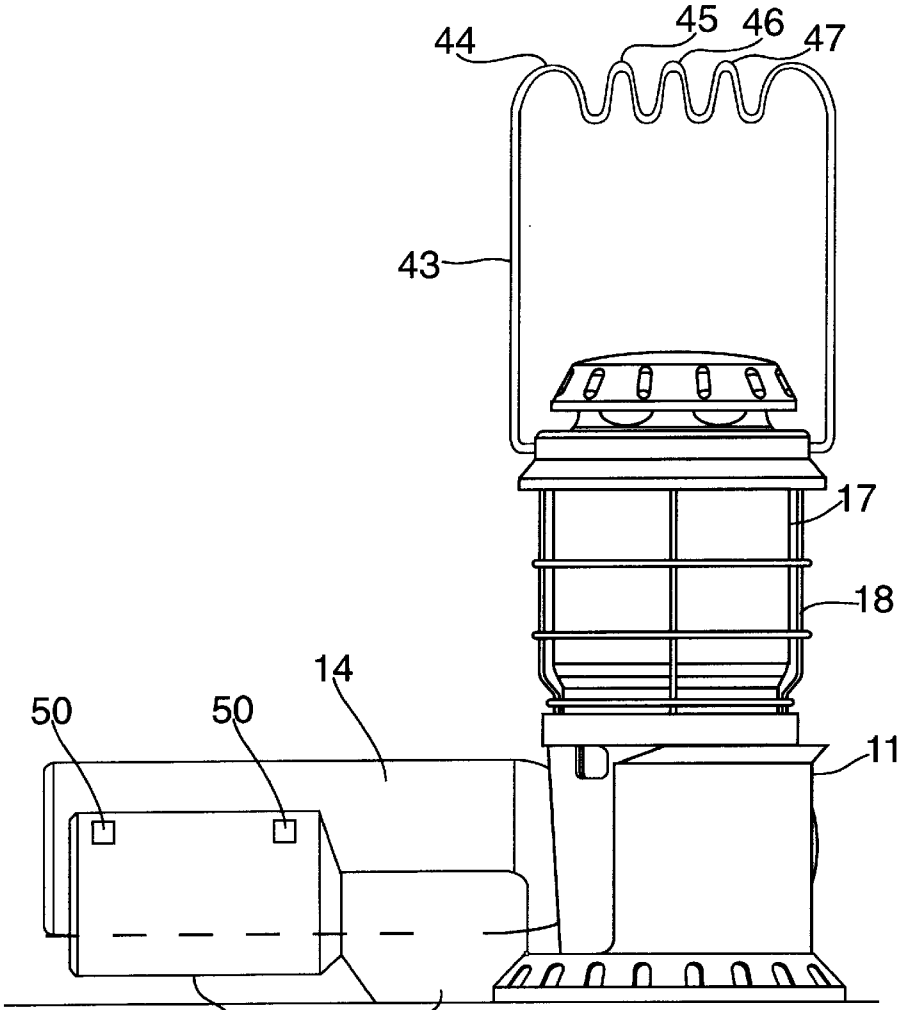
FIG. 3A is a side view of a lantern in accordance with a third embodiment of the present invention, with the shield in the open position and a fuel container installed.
Figure 4:
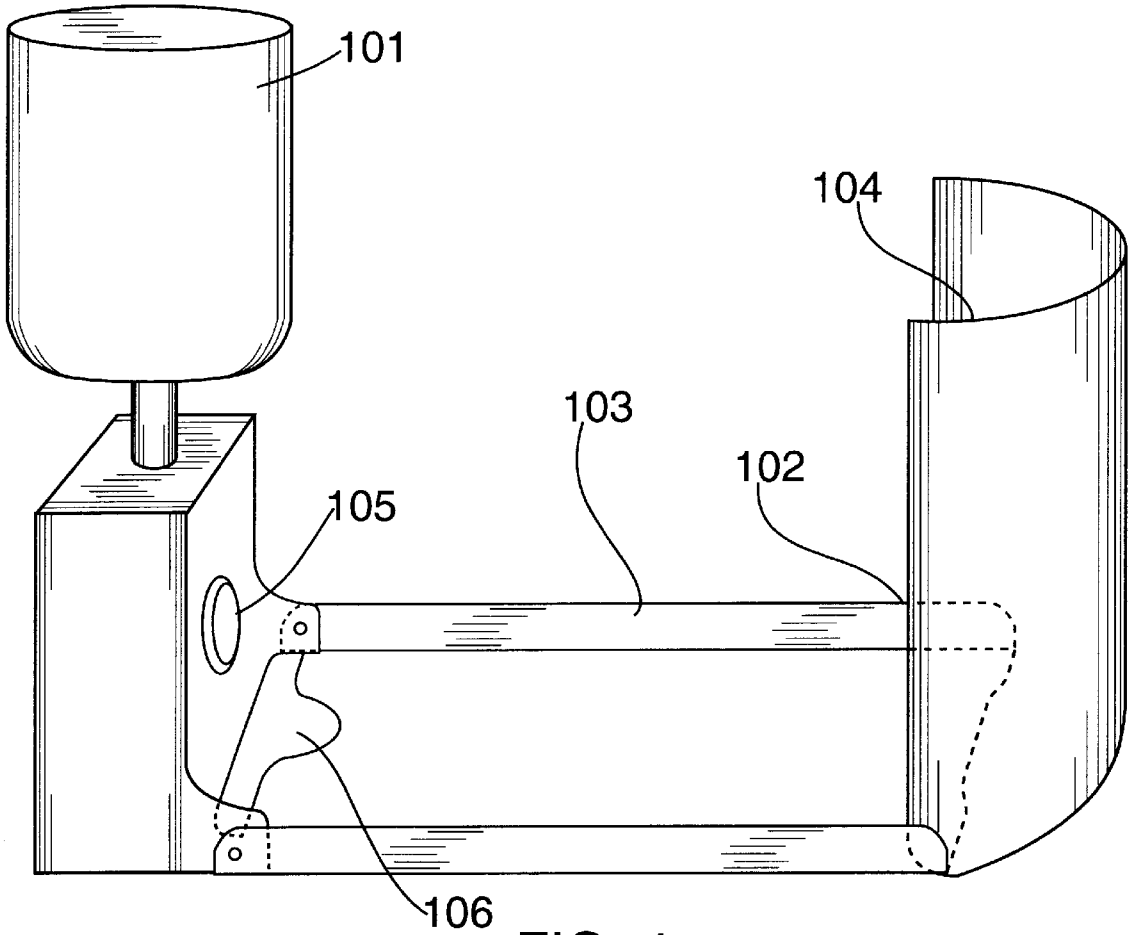
FIG. 4 PRIOR ART
FIG. 4 is a perspective view of a prior art lantern.

FIGS. 3A and 3B shows a third embodiment that protects the remaining section of the flame guard 17, 18. Most of the elements in this embodiment are also the same as in the first embodiment described above. However, in place of the hinged second shield 25 of the first embodiment, this embodiment uses a detachable second shield 48 that mates with the hinged first shield 20 described above. The second shield 48 can connect to the first shield 20 by, for example, spring loaded leafs 49 that mate with corresponding notches 50. Preferably, a corresponding set of leafs and notches are also provided at the rear (not shown). Alternative mechanisms can be readily envisioned by those skilled in the art, including but not limited to, reversing the positions of the leafs and the notches, or using snaps, latches, magnets, tongues and grooves, or the like. As with the first embodiment, the second shield 48 preferably covers the entire region that is not covered by the first shield, and can be made of multiple sections connected by hinges.

When the second shield 48 is removed, it can be nested on either the inside or the outside of the first shield 20 while the lantern is in use. In this configuration, the second shield 48 may be fastened for storage to the first shield 20 using an appropriate fastener (not shown) including, but not limited to, clips and snaps.

The outer face of the first shield 20 in this embodiment includes a protrusion 41 that serves as a foot to stabilize the lantern when the first shield 20 is opened. Of course, this protrusion 41 could be used in any of the embodiments described above, or the bases of those embodiments could be used in this embodiment.

With reference to FIG. 3A, a crenulated wire bail 43 (or handle) is used to compensate for the shift in the lantern's center of gravity when the lantern is hung from a hook or wire. The bail 43 is oriented so that the crenulations 44–47 run in the direction of the length of the fuel container 14. This allows the user to compensate for shifts in the center of gravity by hanging the lantern from a crenulation 44–47, 45 located between the center of the bail 43 and the fuel container. The lanterns in accordance with the present invention can be used with fuel containers of different sizes and weight. The user will select an appropriate crenulation 44–47 to hang the lantern from, depending on the size and weight of the fuel container. This selection can be adjusted by the user as the weight of the container decreases when the fuel is consumed. Of course, while the crenulated bail 43 is only shown in this embodiment, it may be incorporated into any of the embodiments described above as well.

While the present invention has been described above with reference to the specific embodiments, it is to be understood that the present invention is not limited to those precise embodiments. Changes and modifications can be effected without departing from the scope or spirit of the present invention.

We claim:

1. A lantern comprising:

a housing;

a fuel inlet connected to the housing for receiving fuel from a fuel container;

a fuel outlet connected to the housing for discharging the fuel into a fuel-burning region; and a shield hingedly connected to the housing to allow movement between a closed position in which the shield blocks access to at least a portion of the fuel-burning region and covers the fuel inlet, and an open position in which the shield does not block access to the fuel-burning region and the fuel inlet is uncovered.

2. The lantern according to claim 1, further comprising a flame guard surrounding the fuel-burning region.

3. The lantern according to claim 2, wherein the shield comprises a first shield hingedly connected to the housing and a second shield that is removably affixable to the flame guard so that when the first shield is in the closed position and the second shield is affixed to the flame guard, the second shield blocks access to portions of the of the fuel-burning region that are not blocked by the first shield.

4. The lantern according to claim 3, wherein an inside of the second shield comprises a light reflector.

5. The lantern according to claim 2, wherein the flame guard comprises at least one of wire and glass components.

6. The lantern according to claim 1, further comprising a ventilator disposed above the fuel-burning region.

7. The lantern according to claim 6, further comprising a crenulated bail affixed to the ventilator, with the crenulations running in a direction of a length of the fuel container when the fuel container is attached to the fuel inlet.

8. The lantern according to claim 1, wherein, in the open position, the shield supports the fuel container.

9. The lantern according to claim 1, wherein the shield comprises a first shield hingedly connected to the housing and a second shield hingedly connected to the first shield, with the axis of the hinged connection between the first shield and the second shield being substantially perpendicular to the axis of the hinged connection between the first shield and the housing, so that when the first shield is in the closed position and the second shield is in a closed position, the second shield blocks access to portions of the fuel-burning region that are not blocked by the first shield.

10. The lantern according to claim 1, wherein the shield comprises a first shield hingedly connected to the housing and a second shield that is removably affixable to the first shield so that when the first shield is in the closed position and the second shield is affixed to the first shield, the second shield blocks access to portions of the of the fuel-burning region that are not blocked by the first shield.

11. The lantern according to claim 1, wherein the housing includes an elongated base to support the lantern when the fuel container is attached to the fuel inlet.

12. The lantern according to claim 1, wherein the shield includes a foot to support the lantern when the shield is in the open position and the fuel container is attached to the fuel inlet.

13. The lantern according to claim 1, further comprising a control knob of a valve, wherein the control knob and the fuel inlet are located on opposite sides of the housing.

14. The lantern according to claim 1, wherein, when the shield is in the closed position, the shield presses against the fuel inlet.

15. The lantern according to claim 1, wherein, when the shield is in the closed position, the shield closely abuts the fuel inlet.

16. A lantern comprising:

a housing;

a fuel inlet connected to the housing for receiving fuel from a fuel container;

a fuel outlet connected to the housing for discharging the fuel into a fuel-burning region;

a flame guard surrounding the fuel-burning region;

a ventilator disposed above the fuel-burning region and the flame guard; and a shield hingedly connected to the housing to allow movement between a closed position in which the shield blocks access to at least a portion of the fuel-burning region and covers the fuel inlet, and an open position in which the shield does not block access to the fuel-burning region and the fuel inlet is uncovered.

17. The lantern according to claim 16, wherein, in the open position, the shield supports the fuel container.

18. The lantern according to claim 16, wherein the shield comprises a first shield hingedly connected to the housing and a second shield hingedly connected to the first shield, with the axis of the hinged connection between the first shield and the second shield being substantially perpendicular to the axis of the hinged connection between the first shield and the housing, so that when the first shield is in the closed position and the second shield is in a closed position, the second shield blocks access to portions of the fuel-burning region that are not blocked by the first shield.

19. The lantern according to claim 16, wherein the shield comprises a first shield hingedly connected to the housing and a second shield that is removably affixable to the first shield so that when the first shield is in the closed position and the second shield is affixed to the first shield, the second shield blocks access to portions of the of the fuel-burning region that are not blocked by the first shield.

20. The lantern according to claim 16, wherein the shield comprises a first shield hingedly connected to the housing and a second shield that is removably affixable to the flame guard so that when the first shield is in the closed position and the second shield is affixed to the flame guard, the second shield blocks access to portions of the of the fuel-burning region that are not blocked by the first shield.

21. The lantern according to claim 20, wherein an inside of the second shield comprises a light reflector.

22. The lantern according to claim 16, wherein the flame guard comprises at least one of wire and glass components.

23. The lantern according to claim 16, further comprising a crenulated bail affixed to the ventilator, with the crenulations running in a direction of a length of the fuel container when the fuel container is attached to the fuel inlet.

24. The lantern according to claim 16, wherein the housing includes an elongated base to support the lantern when the fuel container is attached to the fuel inlet.

25. The lantern according to claim 16, wherein the shield includes a foot to support the lantern when the shield is in the open position and the fuel container is attached to the fuel inlet.

26. The lantern according to claim 16, further comprising a control knob of a valve, wherein the control knob and the fuel inlet are located on opposite sides of the housing.

27. The lantern according to claim 16, wherein, when the shield is in the closed position, the shield presses against the fuel inlet.

28. The lantern according to claim 16, wherein, when the shield is in the closed position, the shield closely abuts the fuel inlet.

29. A lantern comprising:

a housing having a sidewall, and a top, the sidewall having an opening therein;

a fuel inlet fitted in the opening of the sidewall for receiving fuel from a fuel container;

a fuel outlet connected to the housing for discharging the fuel into a fuel-burning region located above the top of the housing;

a valve for selectively passing and blocking the flow of fuel from the fuel inlet to the fuel outlet;

a substantially cylindrical flame guard radially surrounding the fuel-burning region;

a ventilator disposed above the fuel-burning region; and a shield having a substantially cylindrical inner face hingedly connected to the housing to allow movement between a closed position in which the shield covers the fuel inlet and the flame guard nests inside the inner face on the same side of the housing as the fuel inlet, and an open position in which the shield does not cover the fuel inlet and, when the fuel container is connected to the fuel inlet, the fuel container nests inside the inner face.

30. The lantern according to claim 29, wherein, in the open position, the shield supports the fuel container.

31. The lantern according to claim 29, wherein the shield comprises a first shield hingedly connected to the housing and a second shield having a substantially cylindrical inner face, the second shield hingedly connected to the first shield, with the axis of the hinged connection between the first shield and the second shield being substantially perpendicular to the axis of the hinged connection between the first shield and the housing, so that when the first shield is in the closed position and the second shield is in a closed position, the second shield blocks access to substantially all portions of the flame guard that are not blocked by the first shield.

32. The lantern according to claim 29, wherein the shield comprises a first shield hingedly connected to the housing and a second shield having a substantially cylindrical inner face, the second shield being removably affixable to the first shield so that when the first shield is in the closed position and the second shield is affixed to the first shield, the second shield blocks access to substantially all portions of the of the flame guard that are not blocked by the first shield.

33. The lantern according to claim 29, wherein the shield comprises a first shield hingedly connected to the housing and a second shield having a substantially cylindrical inner face, the second shield being removably affixable to the flame guard so that when the first shield is in the closed position and the second shield is affixed to the flame guard, the second shield blocks access to substantially all portions of the flame guard that are not blocked by the first shield.

34. The lantern according to claim 33, wherein an inside of the second shield comprises a light reflector.

35. The lantern according to claim 29, wherein the flame guard comprises at least one of wire and glass components.

36. The lantern according to claim 29, further comprising a crenulated bail affixed to the ventilator, with the crenulations running in a direction of a length of the fuel container when the fuel container is attached to the fuel inlet.

37. The lantern according to claim 29, wherein the housing includes an elongated base to support the lantern when the fuel container is attached to the fuel inlet.

38. The lantern according to claim 29, wherein the shield includes a foot to support the lantern when the shield is in the open position and the fuel container is attached to the fuel inlet.

39. The lantern according to claim 29, further comprising a control knob of the valve, wherein the control knob and the fuel inlet are located on opposite sides of the housing.

40. The lantern according to claim 29, wherein, when the shield is in the closed position, the shield presses against the fuel inlet.

41. The lantern according to claim 29, wherein, when the shield is in the closed position, the shield closely abuts the fuel inlet.

* * * * *